US007803045B2

(12) United States Patent
Wadleigh et al.

(10) Patent No.: US 7,803,045 B2
(45) Date of Patent: Sep. 28, 2010

(54) WAGERING GAME WITH COMMUNICATION FEATURE FOR SPECIAL WAGERS

(75) Inventors: William R. Wadleigh, Lisle, IL (US); Shridhar P. Joshi, Naperville, IL (US); Joel R. Jaffe, Glenview, IL (US)

(73) Assignee: WMS Gaming, Inc., Waukegan, IL (US)

( * ) Notice: Subject to any disclaimer, the term of this patent is extended or adjusted under 35 U.S.C. 154(b) by 799 days.

(21) Appl. No.: 11/241,123

(22) Filed: Sep. 30, 2005

(65) Prior Publication Data

US 2006/0068894 A1 Mar. 30, 2006

Related U.S. Application Data

(60) Provisional application No. 60/614,935, filed on Sep. 30, 2004.

(51) Int. Cl.
*A63F 9/24* (2006.01)

(52) U.S. Cl. ..... 463/22; 463/27

(58) Field of Classification Search ..... 463/22, 463/27; 273/138, 143 R
See application file for complete search history.

(56) References Cited

U.S. PATENT DOCUMENTS

| | | | | |
|---|---|---|---|---|
| 4,695,053 | A | 9/1987 | Vazquez, Jr. et al. | |
| 5,833,537 | A | 11/1998 | Barrie | |
| 6,056,642 | A | 5/2000 | Bennett | |
| 6,068,552 | A | 5/2000 | Walker et al. | |
| 6,089,977 | A | 7/2000 | Bennett | |
| 6,110,041 | A | 8/2000 | Walker et al. | |
| 6,159,096 | A | 12/2000 | Yoseloff | |
| 6,190,254 | B1 | 2/2001 | Bennett | |
| 6,210,277 | B1 * | 4/2001 | Stefan | 463/27 |
| 6,251,013 | B1 | 6/2001 | Bennett | |
| 6,270,411 | B1 | 8/2001 | Gura et al. | |
| 6,311,976 | B1 * | 11/2001 | Yoseloff et al. | 273/138.2 |
| 6,319,124 | B1 | 11/2001 | Baerlocher et al. | |
| 6,350,199 | B1 | 2/2002 | Williams et al. | |
| 6,520,856 | B1 | 2/2003 | Walker et al. | |
| 6,565,433 | B1 | 5/2003 | Baerlocher et al. | |
| 6,676,513 | B2 * | 1/2004 | Gauselmann | 463/20 |

(Continued)

FOREIGN PATENT DOCUMENTS

| | | | |
|---|---|---|---|
| GB | 2092797 | A | 8/1982 |

(Continued)

*Primary Examiner*—Peter DungBa Vo
*Assistant Examiner*—Omkar Deodhar
(74) *Attorney, Agent, or Firm*—Nixon Peabody LLP

(57) ABSTRACT

A communication feature or a plurality of communication features allows a player to know that he or she has selected a special event to be conducted in the wagering game. Generally, the player must meet certain criteria (e.g., play the maximum number of paylines) or, perhaps, make an additional wager to be eligible for the special event. The communication features may include (i) an indicator within the player-input device that is used to allow the player to select the special event, (ii) a banner that is displayed prior to and during the wagering game that indicates that the special event is activated, (iii) a placard that is displayed prior to the wagering game that indicates that the special event is activated, and/or (iv) the altering of one or more symbols that are used to indicate the randomly selected outcome of the wagering game.

20 Claims, 8 Drawing Sheets

U.S. PATENT DOCUMENTS

| | | | | |
|---|---|---|---|---|
| 6,731,313 | B1 * | 5/2004 | Kaminkow | 715/839 |
| 6,780,109 | B2 | 8/2004 | Kaminkow | |
| 6,805,349 | B2 | 10/2004 | Baerlocher et al. | |
| 6,837,790 | B1 | 1/2005 | Kaminkow | |
| 6,855,054 | B2 | 2/2005 | White et al. | |
| 6,905,406 | B2 | 6/2005 | Kaminkow et al. | |
| 6,918,832 | B2 | 7/2005 | Baerlocher et al. | |
| 6,921,335 | B2 | 7/2005 | Rodgers et al. | |
| 6,939,223 | B1 | 9/2005 | Jones | |
| 6,939,226 | B1 | 9/2005 | Joshi | |
| 6,960,136 | B2 | 11/2005 | Joshi et al. | |
| 6,974,385 | B2 | 12/2005 | Joshi et al. | |
| 6,981,635 | B1 | 1/2006 | Hughs-Baird et al. | |
| 6,986,709 | B2 | 1/2006 | Hughs-Baird et al. | |
| 7,121,942 | B2 | 10/2006 | Baerlocher | |
| 7,169,042 | B2 | 1/2007 | Muir et al. | |
| 7,281,977 | B2 | 10/2007 | Jones | |
| 7,354,344 | B2 | 4/2008 | Paulsen et al. | |
| 7,381,134 | B2 | 6/2008 | Cuddy et al. | |
| 2002/0142825 | A1 | 10/2002 | Lark et al. | |
| 2002/0142846 | A1 | 10/2002 | Paulsen | |
| 2003/0003988 | A1 | 1/2003 | Walker et al. | |
| 2003/0186737 | A1 | 10/2003 | Bennett et al. | |
| 2004/0053672 | A1 | 3/2004 | Baerlocher | |
| 2004/0097279 | A1 | 5/2004 | Gauselmann | |
| 2004/0097280 | A1 | 5/2004 | Gauselmann | |
| 2004/0219968 | A1 | 11/2004 | Fiden | |
| 2004/0229679 | A1 | 11/2004 | Anderson et al. | |
| 2005/0049030 | A1 | 3/2005 | Tachikawa | |
| 2005/0170890 | A1 | 8/2005 | Rowe et al. | |
| 2005/0282607 | A1 | 12/2005 | Gauselmann | |
| 2006/0058097 | A1 | 3/2006 | Berman et al. | |
| 2008/0214292 | A1 | 9/2008 | Bryant et al. | |

FOREIGN PATENT DOCUMENTS

| | | | |
|---|---|---|---|
| GB | 2096376 | A | 10/1982 |
| GB | 2097160 | A | 10/1982 |
| GB | 2119991 | A | 11/1983 |
| GB | 2137392 | A | 10/1984 |
| WO | WO01/51143 | | 7/2001 |

* cited by examiner

WAGERING GAME WITH COMMUNICATION FEATURE FOR SPECIAL WAGERS

CROSS-REFERENCE TO RELATED APPLICATION

This application claims the benefit of the U.S. Provisional Application 60/614,935 filed on Sep. 30, 2004 and entitled "Wagering Game With Communication Feature For Special Wagers" and this provisional application is hereby incorporated by reference in its entirety.

FIELD OF THE INVENTION

The present invention relates generally to gaming terminals for playing a wagering game and, more particularly, to a wagering game having a unique feature for informing the player that he or she has made a wager on a special event.

BACKGROUND OF THE INVENTION

Gaming terminals, such as slot machines, video poker machines, and the like, have been a cornerstone of the gaming industry for several years. Generally, the popularity of such terminals with players is dependent on the likelihood (or perceived likelihood) of winning money at the terminal and the intrinsic entertainment value of the terminal relative to other available gaming options. Where the available gaming options include a number of competing terminals and the expectation of winning each terminal is roughly the same (or believed to be the same), players are most likely to be attracted to the most entertaining and exciting of the terminals.

Consequently, shrewd operators strive to employ the most entertaining and exciting terminals available because such terminals attract frequent play and, hence, increase profitability to the operator. In the competitive gaming terminal industry, there is a continuing need for gaming terminal manufacturers to produce new types of games, or enhancements to existing games, which will attract frequent play by increasing the entertainment value and excitement associated with the game.

One concept that has been successfully employed to enhance the entertainment value of a game is that of a "secondary" or "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a progressive jackpot. In the gaming industry, a "progressive" involves collecting coin-in data from participating gaming device(s) (e.g., slot machines), contributing a percentage of that coin-in data to a jackpot amount, and awarding that jackpot amount to a player upon the occurrence of a certain jackpot-won event. The percentage of the coin-in is determined prior to any result being achieved and is independent of any result. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

In existing games, the player may often be required to make an additional wager to become eligible for a special event (e.g., an additional award in the basic game, entry into the progressive game, entry into the bonus game, etc.). While the "HELP" screen in many video gaming terminals may assist the player in this regard, enhanced communication would help the player understand these special events, leading to more wagering on these special events. Of course, additional wagering is beneficial to the gaming establishment in which the gaming terminal is located. The present invention is directed to satisfying this and other needs.

SUMMARY OF THE INVENTION

The present invention is directed to a communication feature or a plurality of communication features that allow a player to know that he or she has selected a certain special event that is to be conducted in the wagering game. Generally, the player must meet certain criteria (e.g., playing the maximum number of paylines) to be eligible for the special event. The player also may be required to make an additional wager such that the communication feature of the present invention also allows the player to understand that he or she is making this additional wager. The communication features may include (i) an indicator (e.g., a light) within the player-input device that is used to allow the player to select the special event, (ii) a banner that is displayed prior to and during the wagering game that indicates that the special event is activated, (iii) a placard that is displayed prior to the wagering game that indicates that the special event is activated, and/or (iv) the altering of one or more symbols that are used to indicate the randomly selected outcome of the wagering game.

In particular, the present invention can be considered a method of communicating to a player at a gaming terminal that a special event for a wagering game has been enabled. The method comprises, in response to the player selecting the special event, displaying information on a banner on a display at the gaming terminal to indicate that the special event has been selected. Further, in response to said player selecting the special event, altering one of the symbols that is used to indicate a randomly selected outcome of the wagering game from an original state to a special state to indicate that the special event has been enabled. Finally, the method includes conducting the game with the special event if the player has selected the special event. The method may also optionally include enabling a placard prior to the conducting of the wagering game, and activating an indicator associated with the player-input device that allows the player to select the special event. In other aspects of the method, the player may select the special event via a player-input device, the method further including activating an indicator associated with the player-input device in response to the player selecting the special event via the player-input device. The activating act may include activating an indicator light within the player-input device. The player-input device may comprise a push button and the above-noted light may be disposed within the push button or otherwise disposed to internally illuminate the push button. In still other aspects of the method, the banner may be displayed prior to and during the wagering game and/or a placard may be displayed indicating that the special event is activated in response to the player selecting the special event.

The present invention can be considered a gaming terminal, comprising at least one display, a player-input device that includes an indicator, and a controller. The display displays the wagering game to the player. The wagering game includes symbols indicating a randomly selected outcome. The player-input device allows a player to select a special event associated with the wagering game. The player-input device includes an indicator for indicating whether said special event has been selected. The controller is coupled to the display and the player-input device. The controller is operative to cause one of the symbols to be altered from an original state to a special state to indicate that a special event has been enabled and to activate the indicator of the player-input device in response to the player selecting the special event via the player-input device. In various aspects of this gaming terminal in accord with the present concepts, the indicator may be a light which, in one aspect, may be located within the player-input device, and the player-input device may comprise a push button. In other aspects, the one symbol noted above may have the same value in a paytable for the wagering game, regardless of whether the special event has been enabled. In a further optional aspect of this gaming terminal, the display may include a placard region, and the controller may be further operative to cause the placard region to display, prior to and during the wagering game that is conducted at the gaming terminal, information indicating that the special event is enabled, in response to the player selecting the special event via the player-input device. In a further optional aspect of this gaming terminal, the display includes a banner and the controller is further operative to cause the banner to display, prior to and during the wagering game that is conducted at the gaming terminal, information indicating that the special event is enabled, in response to the player selecting the special event via the player-input device.

The present invention can be thought of as a gaming terminal, comprising at least one display, a player-input device that includes an indicator, and a controller. The display displays the wagering game to the player. The wagering game including symbols indicating a randomly selected outcome. The display also includes a banner for displaying information. The player-input device allows a player to select a special event associated with the wagering game. The player-input device includes an indicator for indicating whether said special event has been selected. The controller is coupled to the display and the player-input device. The controller is operative to cause the banner to provide information to the player that the special event is enabled and to activate the indicator of the player-input device in response to the player selecting the special event via the player-input device.

In still another aspect, a method for communicating that a player has made a special wager to be eligible for a special event during a wagering game is provided and includes the step of receiving an input from the player indicating a desire to place the special wager. The method also includes, in response to the receiving of the input, performing at least one of the following acts: (i) activating a light on an input device from which said input is received, (ii) altering a wagering game symbol from an original state to a special state, (iii) displaying a placard to inform said player of said special wager, and (iv) displaying a banner to inform said player of the special wager. In various aspects of this method, all four of the above-noted acts may be performed in response to the receiving act. The indicated special state of the game symbol is a desired symbol that indicates an award from the special event. The special event may a scatter bonus, the special state of the symbol being a symbol that causes the scatter bonus to be awarded or the special event may be a progressive game. The act of activating the light and at least one other of the remaining three acts may be performed in response to the receiving act. The light may be located within a bezel of a push button, the push button being the input device. In still other aspects of the method, each one of the performed acts may define a special state that is derived from an original state in response to the receiving act, the method further including returning the performed acts to the original state in response to the player deselecting the special event from the input device. The input from the player may include a wager on a certain minimum number of paylines, which minimum number may include all of the paylines. In still additional aspects, the placard may disappear when the wagering game is conducted and the wagering game may be conducted with the special event activated.

In yet another aspect of the present concepts, a gaming terminal for playing a wagering game includes a first wager-input device for allowing a player to place a wager on the wagering game and a second wager-input device for allowing a player to place a special wager on a special event that is conducted in conjunction with the wagering game. The gaming terminal also includes an indicator in association with the second wager-input device, the indicator being activated in response to the player making the special wager. In further aspects of this gaming terminal, the indicator may be configured to toggle between an activated state and a deactivated state in response to the player selecting and deselecting to play for the special event. The indicator may be a light, such as an LED, and the special event may be a progressive game. The indicator may also be located within a bezel of a push button, the push button being the second wager-input device.

The above summary of the present invention is not intended to represent each embodiment or every aspect of the present invention, as there are several novel methods and gaming terminals incorporating this communication feature. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
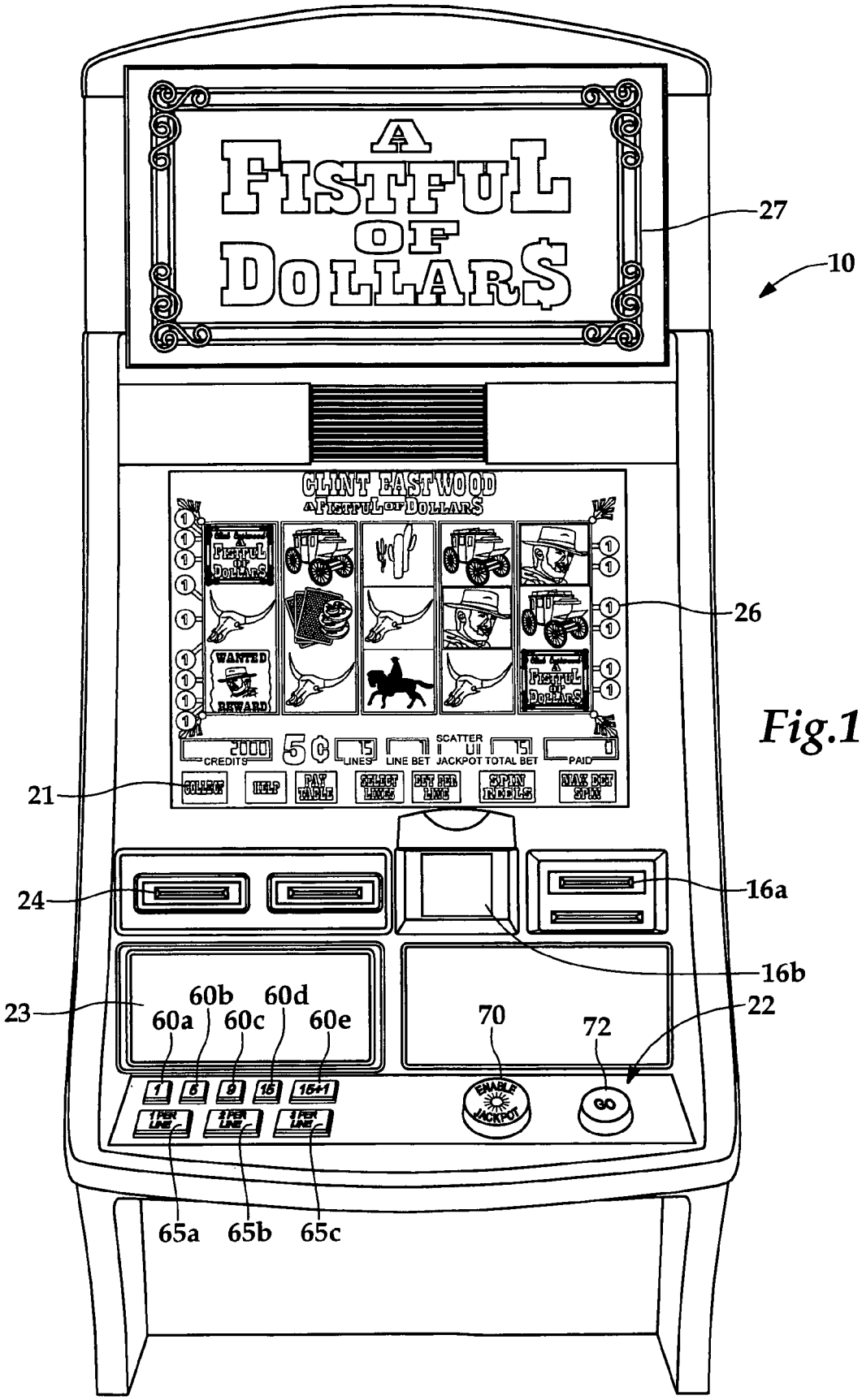
FIG. 1 illustrates a gaming terminal that has the enhanced communication feature in accordance with the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a perspective view of a typical gaming terminal 10 used by gaming establishments, such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play video slots or a video casino game, such as blackjack, slots, keno, poker, etc.

The gaming terminal 10 includes input devices, such as a wager acceptor 16*a*, 16*b*, a touch screen 21, a push-button panel 22, and a player-identification card reader 24. For output, the gaming terminal 10 includes a main display 26 for displaying information about the basic wagering game. The main display 26 can also display information about a bonus wagering game and a progressive wagering game. The gaming terminal 10 also includes a secondary game display 27 for displaying the bonus wagering game, or for displaying award amounts of a progressive game. While these typical components found in the gaming terminal 10 are described below, it should be understood that numerous other elements may exist and may be used in any number of combinations to create various forms of a gaming terminal.

The wager acceptor 16*a*, 16*b* may be provided in many forms, individually or in combination. The wager acceptor 16*a*, 16*b* may include a coin slot acceptor 16*a* or a bill validator 16*b* to input value to the gaming terminal 10. Or, the wager acceptor 16*a*, 16*b* may include a card-reading device for reading a card that has a recorded monetary value with which it is associated. The card may also authorize access to a central account, which can transfer money to the gaming terminal 10.

A payout mechanism 23 performs the reverse functions of the wager acceptor 16. For example, the payout mechanism 23 may include a coin dispenser or a note dispenser to output value from the gaming terminal 10. Also, the payout mechanism 23 may also be adapted to receive a card that authorizes the gaming terminal 10 to transfer credits from the gaming terminal 10 to a central account.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game. The push button panel 22 will be described in more detail with respect to FIG. 3.

The operation of the basic wagering game is displayed to the player on the main display 26. The main display 26 can also display the bonus game associated with the basic wagering game. The main display 26 may take the form of a cathode ray tube (CRT), a high resolution LCD, a plasma display, a LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome.

The player-identification card reader 24 allows for the identification of a player by reading a card with information indicating his or her true identity. Currently, the identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10.

A player begins play of the basic wagering game by inserting a wager input into the wager input accepter 16*a*, 16*b* of the gaming terminal 10. A player can select play by either using the touch screen 21 or the push-button panel 22. The basic game consists of a plurality of symbols on a plurality of reels that are displayed along a plurality of paylines, yielding a plurality of outcomes of the basic game. Such outcomes are randomly selected and then displayed in response to the wagering input by the player.

Figure 2:
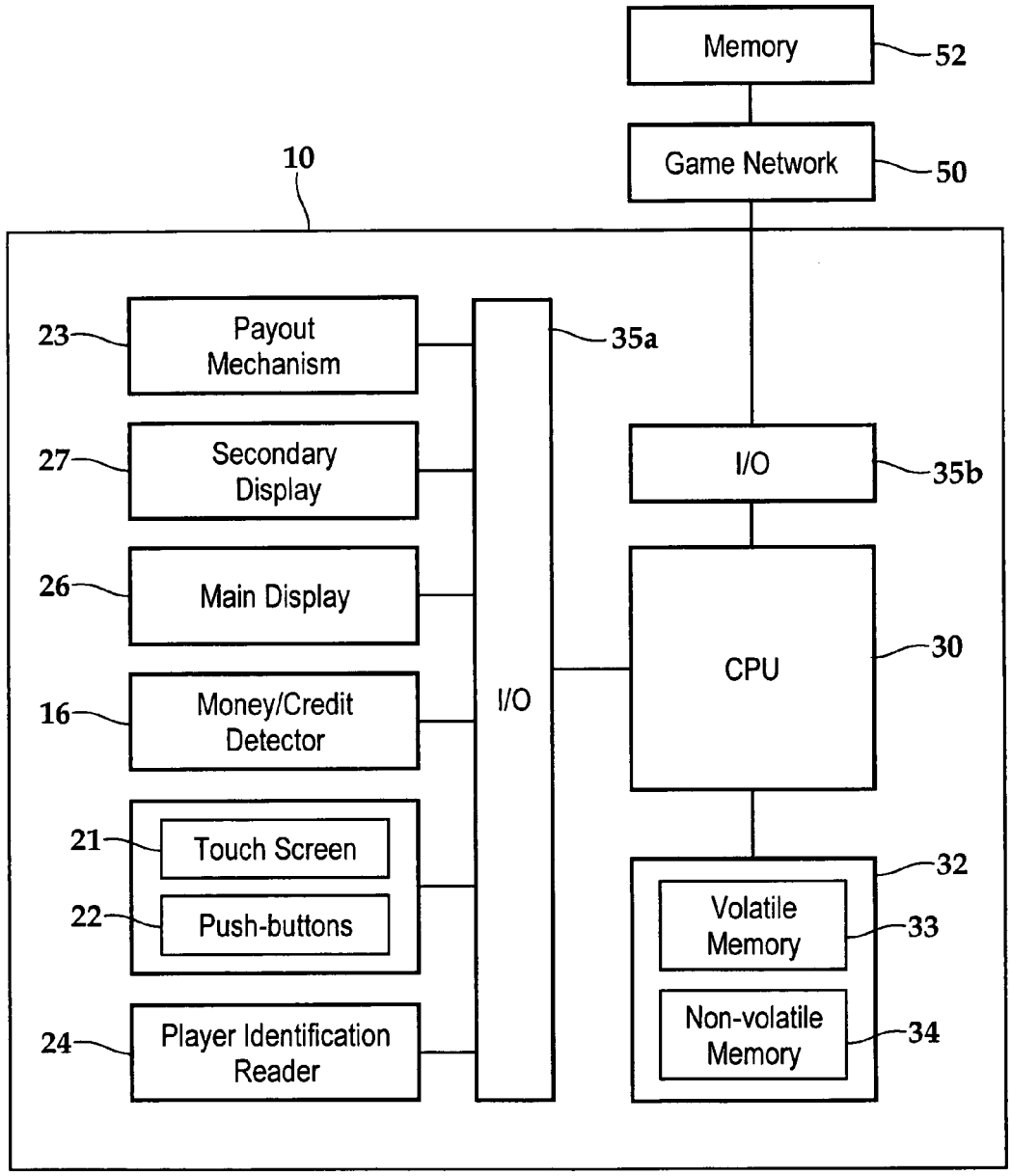
FIG. 2 illustrates a control system that is used in conjunction with the gaming terminal of FIG. 1.

As shown in FIG. 2, the various components of the gaming terminal 10 are controlled by a central processing unit (CPU) 30, also referred to as a processor (such as a microprocessor or microcontroller). To provide the gaming functions, the CPU 30 executes one or more game programs. The CPU 30 performs the random selection of an outcome from the plurality of outcomes of the wagering game. Alternatively, the random selection of an outcome may be performed remotely by a CPU that is networked to the gaming terminal 10 but is not a component of the gaming terminal 10. The CPU 30 is also coupled to or includes a system memory 32. The system memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

The gaming terminal 10 is typically operated as part of a game control network 50 having control circuitry and memory devices. The game control network 50 may optionally include a system memory 52 for alternative storage of data. The gaming terminal 10 often has multiple serial ports, each port dedicated to providing data to a specific host computer system that performs a specific function (e.g., accounting system, player-tracking system, progressive game control system, etc). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the advantages of the RS-485 capability (e.g., multi-drop capability that allows many gaming terminals 10 to communicate with the game control network 50). To perform this function, a custom interface board may be used by the gaming terminal 10 for each communication port in the gaming terminal 10. It should be noted that the gaming terminal 10 can initially be designed to be configured for a typical RS-485 protocol, instead of the typical RS-232 protocol. Further, the gaming terminal 10 may simply be designed for an Ethernet connection to the game control network 50.

Figure 3:
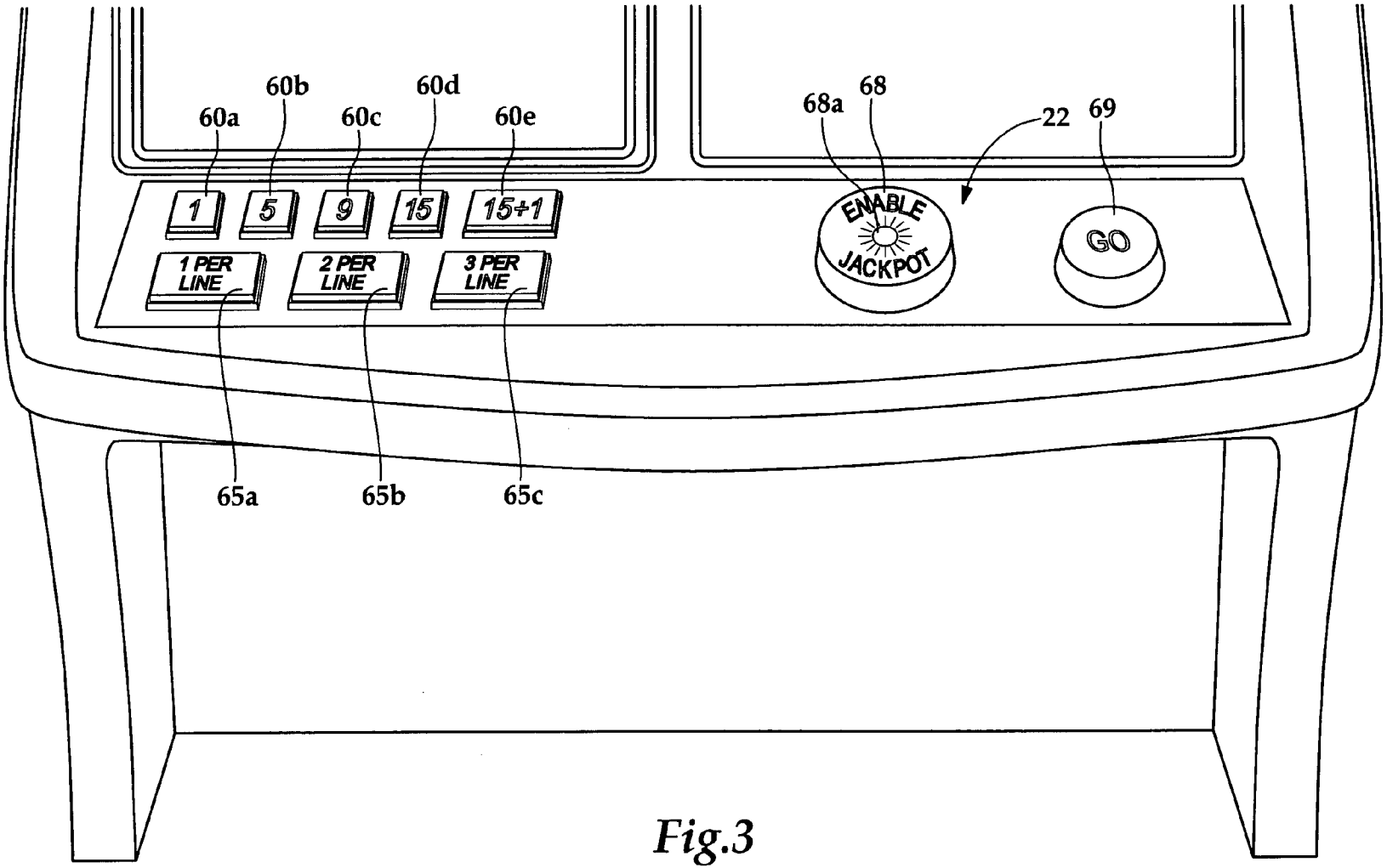
FIG. 3 illustrates a close-up of the button panel on the gaming terminal of FIG. 1.

Referring now to FIG. 3, the push button panel 22 includes a plurality of different buttons that serve different purposes. A plurality of payline buttons 60 indicates the number of paylines that the player desires to play during the wagering game. In the present gaming terminal 10, there are fifteen paylines 72 (FIGS. 4 and 5) that the player may select during the wagering game. However, a gaming terminal according to the present invention can include any number of paylines 72. The gaming terminal 10 also includes maximum payline buttons 65 to allow a player to place one, two, or three credit wagers on each of the fifteen paylines 72. While the present embodiment shows three payline buttons 65, the present invention is useful on gaming terminals 10 having more or less of these payline buttons 65.

One of the payline buttons 60*e* allows the player to select all fifteen paylines 73 plus make an additional wager on a special event. When the player has depressed button 60*e* and then selects the "GO" button 69, the wagering game begins (e.g., reels 70 in FIG. 4 begin spinning) with the special event being conducted in conjunction with the wagering game.

Alternatively, the player can select the "15" payline button 60*d*, and then select an enable-jackpot button 68, to cause the wagering game to begin. Likewise, a player can select one of the maximum payline buttons 65 and then select the enable-jackpot button 68 to start the wagering game.

When a player takes these actions to select the special event, a light 68*a* located within the enable-jackpot button 68 is activated, allowing the player to note that he or she has activated the special event and that he or she is placing the additional wager. The light 68*a*, which is preferably an LED, is located behind the bezel such that the entire button 68 becomes lit when the special event has been selected. If the player depresses the enable jackpot button 68 while it is lit by the light 68*a*, the light 68*a* will then be turned off to indicate that the player has deselected the special event feature. The wagering game can then be conducted without the special event being activated. In other words, the player can make inputs to toggle between selection and deselection of the special event.

It should be noted that the special event in the illustrative embodiment not only requires the player to select that special event, but the player must also meet predetermined criteria to allow for the selection of the special event. Specifically, in the example shown, if the player chooses less than all fifteen of the paylines 72, he or she cannot activate the special event. Other predetermined criteria can be employed as well, such as the identification of certain "lucky" players via a player tracking card, or requiring a certain amount of wagers within a predetermined time or number of spins. Alternatively, no predetermined criteria may be needed to select a special event.

Figure 4A:
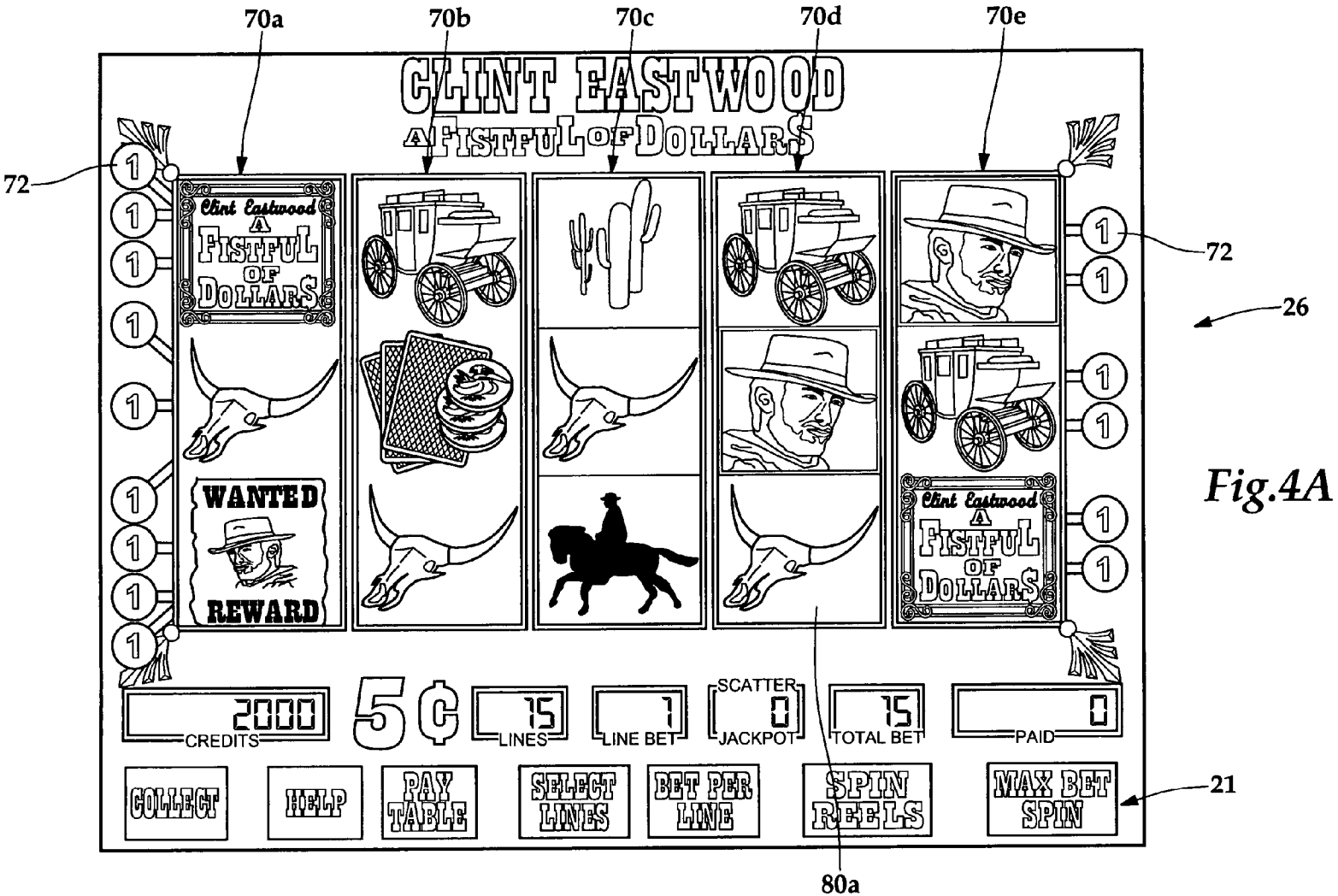
FIGS. 4A and 4B illustrate the main display of the gaming terminal of FIG. 1 in which a symbol has changed to communicate the player's wager of a special event.
Figure 5:
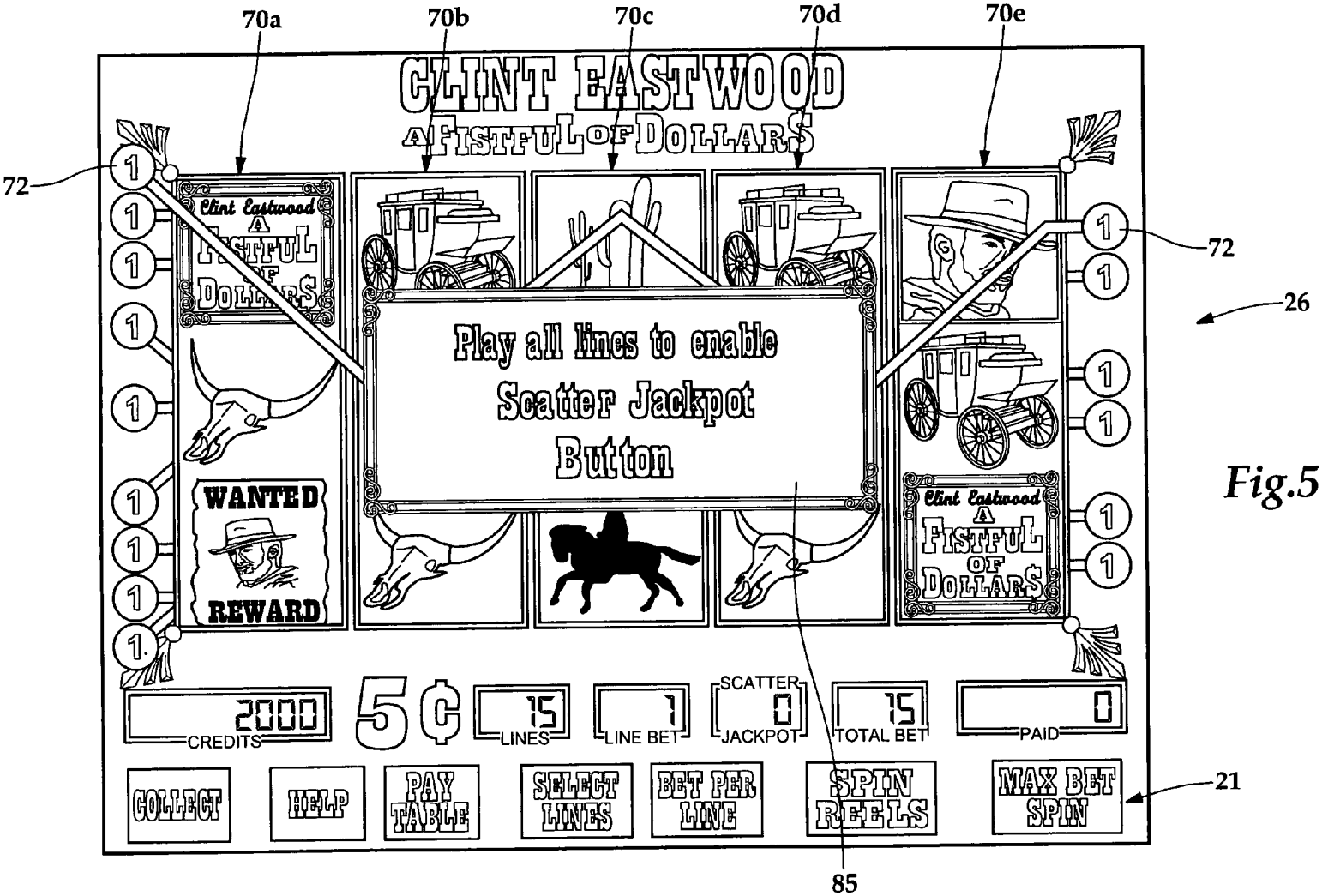
FIG. 5 illustrates the main display of the gaming terminal of FIG. 1 in which a placard communicates the requirements for a player's special wager.

FIG. 4A illustrates the main display 26 of the gaming terminal 10, which includes a plurality of reels 70*a*-70*e*. The reels 70-70*e* include a plurality of symbols that are used to indicate a randomly selected outcome of the wagering game. A plurality of paylines 72 traverse the reels 70-70*e* in a horizontal or zigzag arrangement. A player selects one or more of the paylines 72 and the selected paylines become "active" paylines.

Figure 4B:
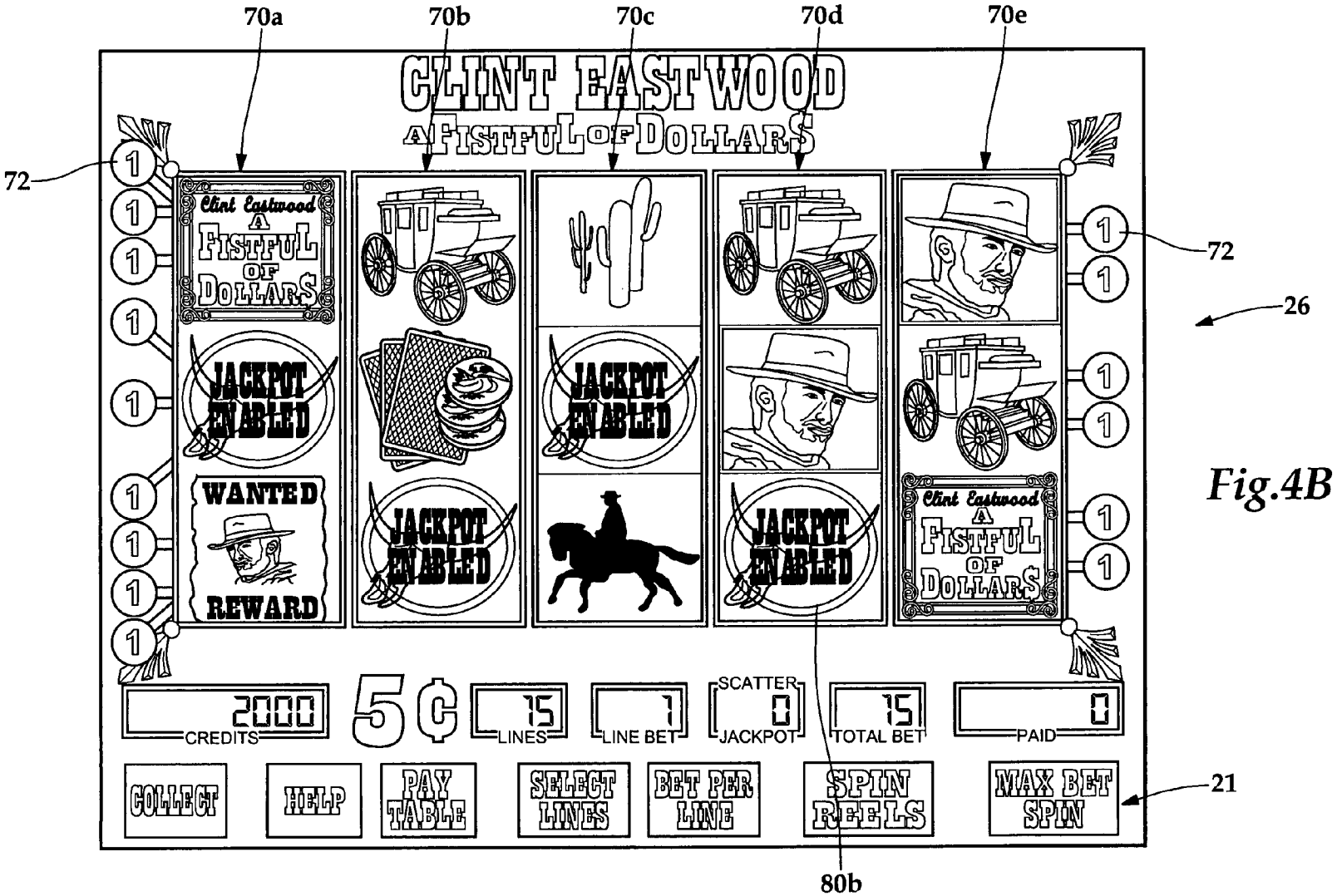

One symbol, the skull symbol 80*a*, is present on the displayed region of the reels 70*a*-70*d* in FIG. 4A. This skull symbol 80*a*, or other designated symbol, is useful for communicating to the player that he or she has chosen to play the special event in the wagering game. As shown in FIG. 4B, the special event is a scatter bonus, whereby a special jackpot or scatter bonus award is awarded if one or more of a certain type of symbol appears anywhere on the main display 26 of the gaming terminal 10, regardless of whether it is located on an active payline.

As shown in FIG. 4B, the skull symbol 80*a* has now changed to a different-looking symbol 80*b*, which indicates the player has selected to play the special event. The player may have made this selection through one of the sequences of push-button selections that are discussed with respect to FIG. 3. This jackpot-enabled symbol 80*b* (i.e., the special state) informs the player that the scatter jackpot is enabled, and that the player has made a special wager to play for the scatter jackpot. Further, if the player changes his or her mind, and chooses not to play for the scatter jackpot by deselecting the enable-jackpot button 68 (FIG. 3), the original state of the skull symbol 80*a* will be displayed on the reels (e.g., 70*a*-70*d*).

The altering of the symbol 80 between the original state as the skull symbol 80*a* and the special state 80*b* may have no impact on the paytable for the wagering game that dictates the awards. In other words, the altering is for visual purposes only. Alternatively, the altered symbol in its special state 80*b* may be the desired scatter symbol that is needed to achieve the scatter jackpot. As such, the special state 80*b* of the symbols remains as the reels 70 spin and stop to indicate the randomly selected outcome.

In embodiments that require certain conditions before allowing a player to select the special event, the gaming terminal 10 may include a help placard 85. If the player attempts to depress the jackpot-enable button 68 of FIG. 3 without making a wager on each of the fifteen paylines 72, then the help placard 85 is displayed to instruct the player what conditions must be met to afford the player the opportunity to play for the special event. Of course, the help placard 85 is merely exemplary, and other types of conditions that must be met can be displayed in the placard 85, as well.

Figure 6:
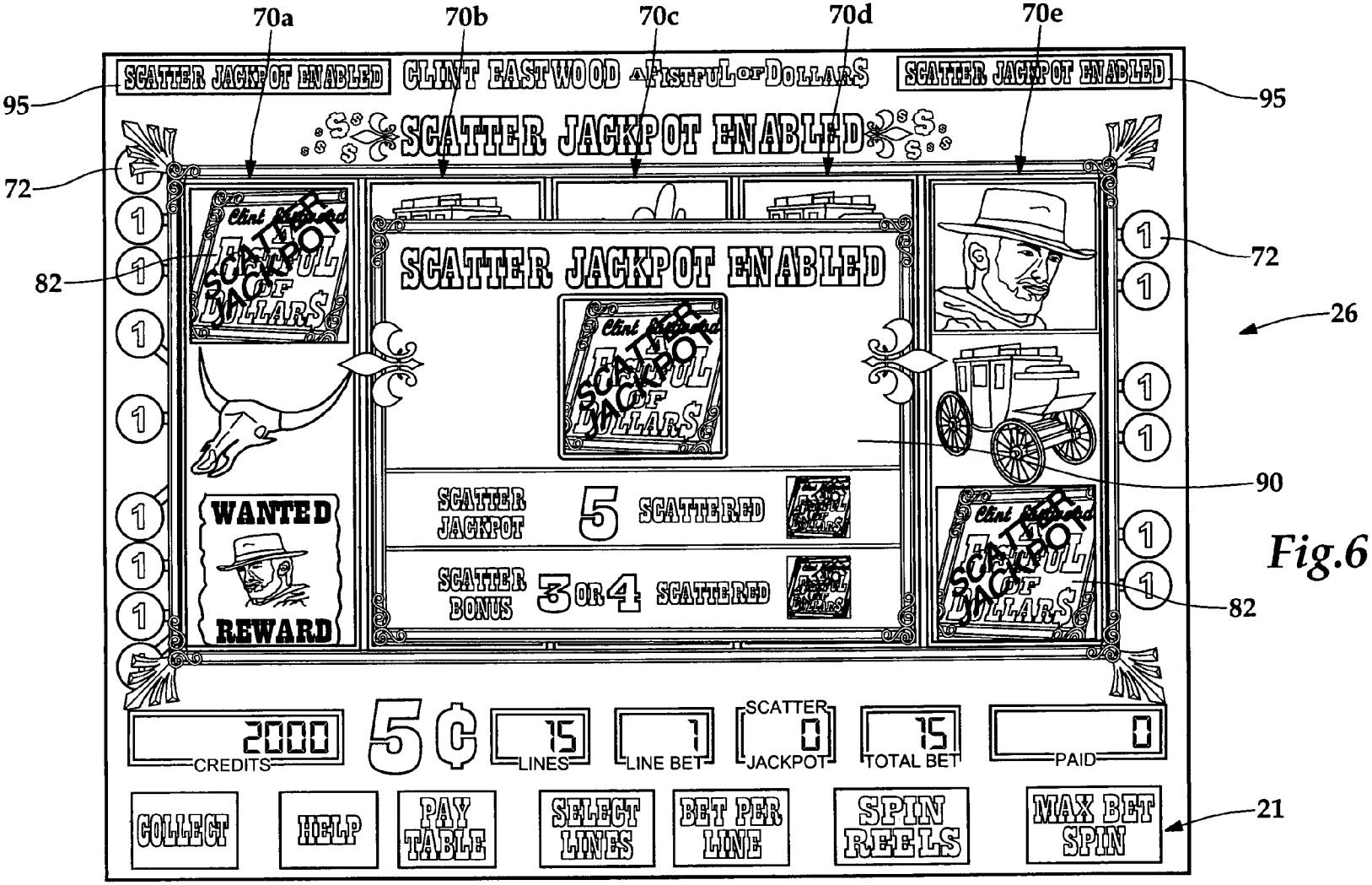
FIG. 6 illustrates the main display of the gaming terminal of FIG. 1 in which a placard and two banners communicate the player's wager of a special event.

FIG. 6 illustrates another embodiment in which the main display 26 provides additional types of information for instructing the player that he or she has enabled the special event. Assuming the player has selected the special event and placed the extra wager associated with this selection, the main display 26 has three different mechanisms for informing the player of the special event. First, like FIGS. 4A-4B, at least one symbol 82 (although a different symbol than the skull symbol 80 in FIGS. 3-4) has been overlayed with special indicia, causing it to be changed from an original state to a special state. Second, a placard 90 has been displayed to instruct the player that the scatter jackpot has been enabled. The placard 90 may also provide a mini-paytable that instructs the player what symbols are needed to achieve the scatter jackpot and the scatter bonus. And third, the main display 26 includes one or more banners 95 located at a desirable region of the main display 26 includes one or more banners 95 located at a desirable region of the main display 26. As shown, there are two banners 95 located horizontally at the top of the main display 26. However, the banners 95 can be located vertically or at other regions of the main display 26.

The main difference between the placard 90 and the banners 95 is that the placard 90 is displayed prior to the wagering game. On the other hand, the banners 95 can be displayed while the wagering game is ongoing, which in this case is while the reels 70*a*-70*e* are spinning. As such, the placard 90 is turned off when the wagering game is initiated so that the player can see all of the reels 70*a*-70*e*. Alternatively, banners 95 that are displayed only during certain time periods before or during the wagering game are contemplated as well.

The banners 95 and the placard 90 are also toggled on and off if the player chooses to deselect the special event prior to conducting the wagering game. The same is true for the symbols 82 in toggling between their original and special states.

Figure 7:
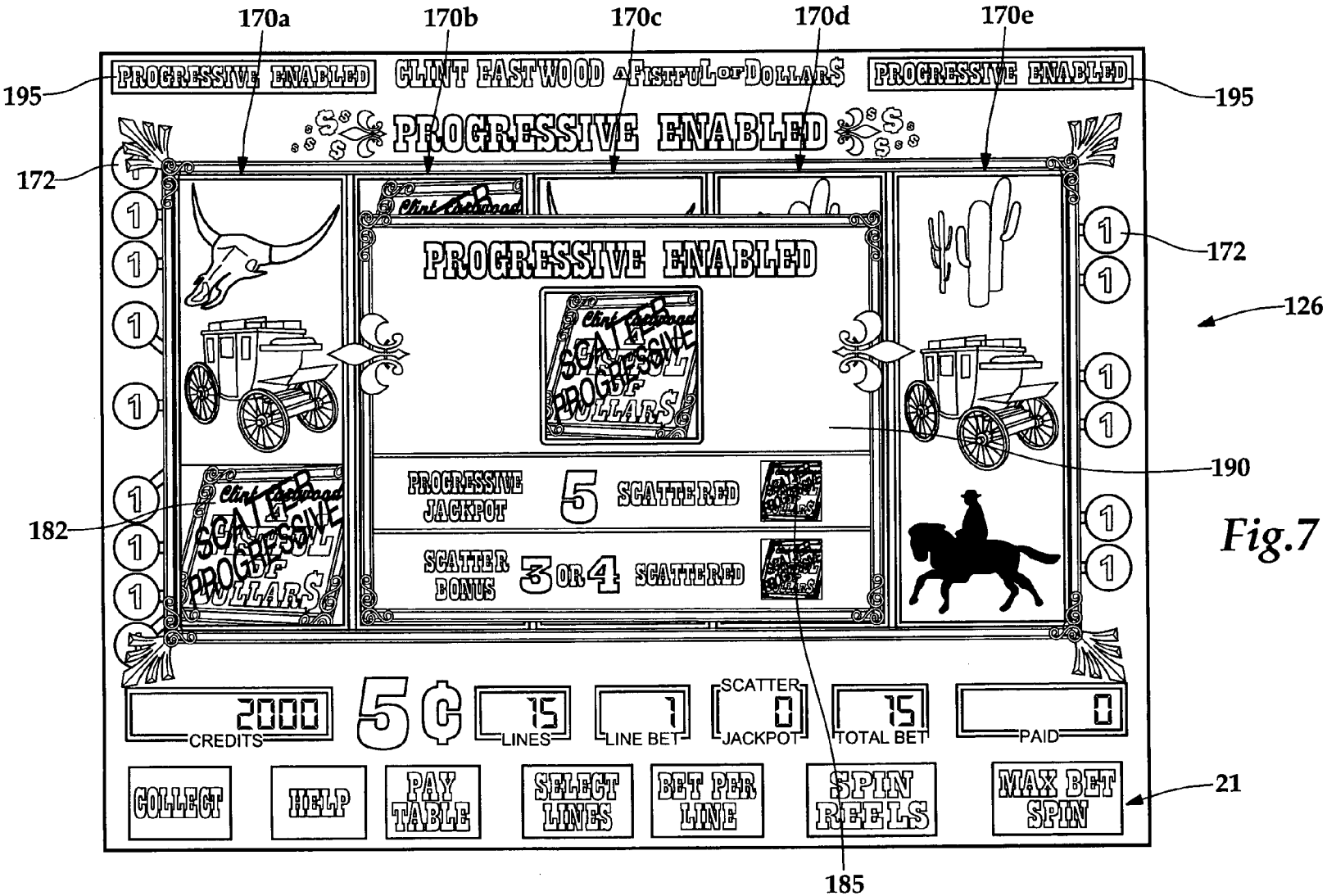
FIG. 7 illustrates the main display of the gaming terminal of FIG. 1 in which a symbol has changed to communicate the player's wager for a progressive game.

FIG. 7 illustrates an alternative embodiment that calls for the special event to be a progressive jackpot that is funded by a portion of the wager inputs received at one or more gaming terminals. A main display 126 includes a plurality of reels 170*a*-170*e* that are capable of awarding the progressive jackpot when it is enabled by selection by the player. The reels 170*a*-170*e* include at least one symbol 182 that transitions from an original state to a special state to indicate that the player is eligible for the progressive jackpot. Further, a placard 190 and two banners 195 are displayed to inform the player that he or she is eligible for the progressive jackpot.

In each embodiment that has been discussed, the player has been required to place an additional wager to be eligible for the special event. Accordingly, all of the communication features can also be considered to provide the player with information about an additional special wager that he or she has made during the wagering game. This, of course, is beneficial as it is imperative to inform the player that an additional wager has been made.

In the examples discussed, it is contemplated that the CPU 30 (FIG. 3) receives the player's inputs and causes the light 68*a* (FIG. 3) and the main display 26 to communicate necessary information. Alternatively, the network 50 may also receive signals corresponding to the player's inputs and provide instructions for the gaming terminal 10 to inform the player of the special event being enabled.

It should be noted that the communication of the special wager can also be performed via audio elements. Thus, in addition to the visual elements that have been previously described, audio elements may also instruct the player that he or she is eligible to win the special event.

While the present invention has been described with reference to one or more particular embodiments, those skilled in the art will recognize that many changes may be made thereto without departing from the spirit and scope of the present invention. For example, the secondary display 27 can also be used to provide placards and banners indicating that the special event has been enabled. Each of these embodiments and obvious variations thereof is contemplated as falling within the spirit and scope of the claimed invention, which is set forth in the following claims.

What is claimed is:

1. A gaming terminal, comprising:

at least one display;

a player-input device allowing a player to selectively enable a special event associated with a subsequent play of said wagering game; and a controller coupled to said player-input device, said display, and a memory storing instructions executable by the controller to cause the display on the display of a wagering game including symbols representing a randomly selected outcome and to cause an appearance of one of said symbols to be altered from a first appearance in an original state to a second appearance in a special state to visually indicate that said special event has been enabled for said subsequent wagering game in response to said player enabling said special event via said player-input device, wherein said controller is further configured, upon an enabling of said special event via said player-input device, to cause said one of said symbols altered from said original state to said special state to further change functionality for said successive wagering game from a first functionality to a second functionality for said subsequent wagering game.

2. The gaming terminal of claim 1, wherein said player-input device can be toggled by said player such that successive activations of said player-input device cause said symbol to alternate between the first appearance and first functionality of the symbol in the original state and the second appearance and second functionality of the symbol in the special state.

3. The gaming terminal of claim 1, wherein said first appearance of said one symbol in said original state and said second appearance of said one symbol in said special state share at least some common features.

4. The gaming terminal of claim 1, wherein said controller is configured to permit selection of said special event by said player only in response to predetermined criteria.

5. The gaming terminal of claim 4, wherein said predetermined criteria is said player placing a wager on a predetermined number of paylines available for selection by said player.

6. The gaming terminal of claim 5, wherein said special event further requires said player to make an additional wager.

7. The gaming terminal of claim 1, wherein said controller is configured to enable said special event responsive to an additional wager dedicated to enabling the special event, and wherein no minimum number of paylines are required to be selected to permit said enabling of said special event.

8. The gaming terminal of claim 1, wherein said first functionality of said one of said symbols consists of a line pay for a predetermined number of said one of said symbols along an active payline, and wherein said second functionality of said one of said symbols in association with said special state comprises a line pay for a predetermined number of said one of said symbols along an active payline and treatment of said one of said symbols as a scatter pay symbol.

9. The gaming terminal of claim 1, wherein said first functionality of said one of said symbols consists of a line pay for a predetermined number of said one of said symbols along an active payline, and wherein said second functionality of said one of said symbols in association with said special state comprises a line pay for a predetermined number of said one of said symbols along an active payline and treatment of said one of said symbols as a progressive jackpot symbol.

10. A gaming terminal, comprising:

at least one display;

a player-input device allowing a player to selectively enable a special event associated with a subsequent play of the wagering game;

and a controller coupled to said player-input device, the display, and a memory storing instructions executable by the controller to cause the display on the display of a wagering game comprising an array of randomly selected symbols selected from a symbol set and to enable the player-input device to be activated only following satisfaction of at least one precondition and, following activation of the player-input device by a player, configured to cause an appearance of a predetermined symbol to be altered from a first appearance in an original state to a second appearance in a special state to visually indicate potential eligibility for a special event in a subsequent play of the wagering game, wherein the at least one precondition comprises an input of an additional wager dedicated to enabling the special event, and wherein the controller, upon activation of the special event by the player via the player-input device, is further configured to cause the predetermined symbol to perform, for the subsequent wagering game, both a base function of a line pay in accord with a pay table and an additional function related to the special event.

11. The gaming terminal of claim 10, wherein the player-input device can be toggled by the player to thereby toggle the predetermined symbol from the original state wherein the predetermined symbol performs only the base function to the special state wherein the predetermined symbol performs both the base function and the additional function.

12. The gaming terminal of claim 11, wherein the first appearance of the predetermined symbol in the original state and the second appearance of the predetermined symbol in the special state share at least one common feature.

13. The gaming terminal of claim 11, wherein the at least one precondition comprises activation of one or more paylines.

14. The gaming terminal of claim 11, wherein the at least one precondition comprises activation of a plurality of paylines.

15. The gaming terminal of claim 11, wherein the at least one precondition comprises activation of all available paylines.

16. The gaming terminal of claim 11, wherein the at least one precondition comprises activation of all available paylines.

17. The gaming terminal of claim 11, wherein the additional function confers eligibility for a scatter bonus award, the scatter bonus award being awarded if one predetermined symbol or more than one predetermined symbols appears anywhere in the array.

18. The gaming terminal of claim 11, wherein the additional function confers eligibility for a progressive jackpot.

19. The gaming terminal of claim 11, wherein the predetermined symbol is selected from a subset of available symbols.

20. A gaming terminal, comprising:

at least one display;

a player-input device allowing a player to selectively enable a special event associated with a subsequent play of the wagering game, the special event comprising a progressive jackpot; and a controller coupled to said player-input device, the display, and a memory storing instructions executable by the controller to cause the display on the display of a wagering game comprising an array of randomly selected symbols selected from a symbol set and to enable the player-input device to be activated responsive to an input of an additional wager dedicated to enabling the special event for a subsequent play of the wagering game and, following activation of the player-input device by a player, configured to cause an appearance of a predetermined symbol to be altered from a first appearance in an original state to a second appearance in a special state to visually indicate potential eligibility for a special event in the subsequent play of the wagering game, and wherein the controller, upon activation of the special event by the player, is further configured to evaluate the array of randomly selected symbols displayed in the subsequent play of the wagering game for any combination of symbols across an active pay line that comprises a winning combination to determine if the predetermined symbol performs both a base function of a line pay in accord with a pay table and an additional function related to the special event.

* * * * *